United States Patent [19]

Karlan

[11] 3,933,265

[45] Jan. 20, 1976

[54] BOTTLE CLOSURE

[76] Inventor: Jac H. Karlan, 5992 Netherland Ave., Riverdale, N.Y. 10471

[22] Filed: Sept. 19, 1972

[21] Appl. No.: 290,418

[52] U.S. Cl. ..... 215/260; 215/270; 215/271

[51] Int. Cl.[2] ..... B65D 51/16

[58] Field of Search ..... 215/41, 42, 56, 37, 38, 215/43, 47, 270, 260, 271; 220/27, 89 A

[56] References Cited

UNITED STATES PATENTS

| | | | |
|---|---|---|---|
| 1,723,790 | 8/1929 | Kirkland | 215/42 |
| 1,865,764 | 7/1932 | Keenan | 215/56 |
| 2,054,034 | 9/1936 | Conner | 215/42 |
| 2,726,002 | 12/1955 | Dalianis | 220/89 A |
| 3,329,295 | 7/1967 | Fields | 215/42 |
| 3,441,161 | 4/1969 | Van Barrn | 215/42 |
| 3,670,915 | 6/1972 | Forman | 215/56 |
| 3,696,957 | 10/1972 | Van Barrn | 215/41 |

FOREIGN PATENTS OR APPLICATIONS

| | | | |
|---|---|---|---|
| 170,310 | 12/1963 | U.S.S.R. | 215/41 |
| 1,150,549 | 1957 | France | 215/56 |
| 1,282,024 | 1960 | France | 215/270 |

*Primary Examiner*—William Price
*Assistant Examiner*—Ro E. Hart

[57] ABSTRACT

A bottle closure of flexible thermoset synthetic material has a corrugated annular insert and an outer wall depending from its base. A thinned portion in the base is of a thickness and geometry adapted to burst at a predetermined pressure within the bottle. An annular shoulder on a severable skirt extends laterally beyond the outer wall which fits against the end of a plunger for urging an internal annular bevel groove in the skirt over an external annular bead near the mouth of the bottle.

8 Claims, 6 Drawing Figures

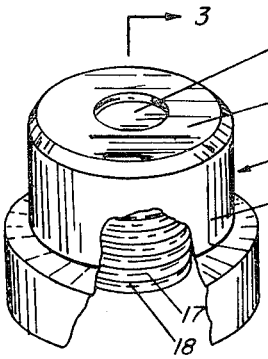
FIG-1.
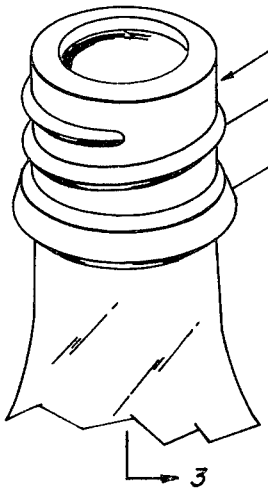
FIG. 2.
FIG.-3.
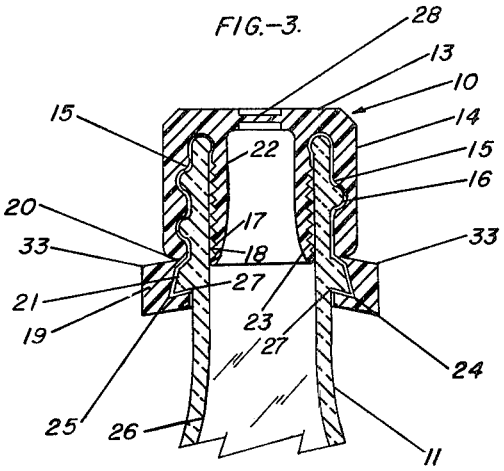
SECTION-3-3
FIG.-4.
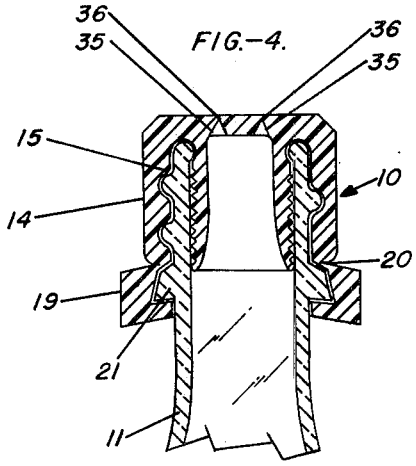
FIG.-5.
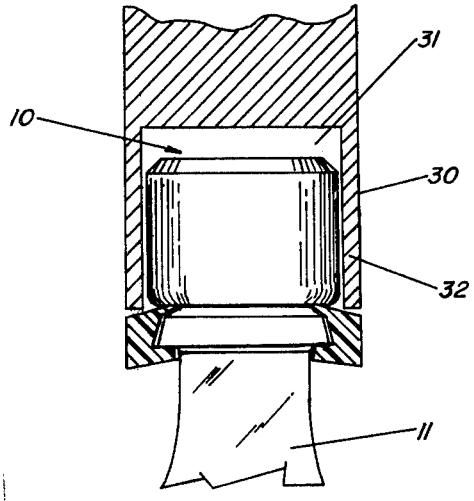
FIG.-6
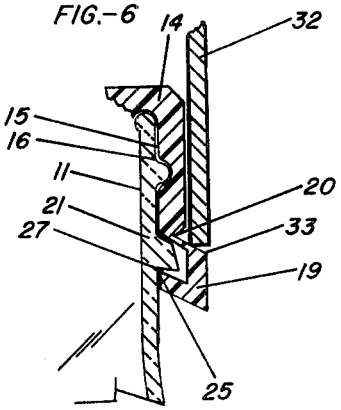

BOTTLE CLOSURE

This invention relates to bottle closures.

The bottling industry has gone to considerable expense and effort to tool for a "screw-on" bottle-cap system that offers two advantages over the previous method: (1) No special tools are needed by the consumer to remove the cap from the bottle. (2) Since the cap is not distorted it is re-useable on the bottle from which it has been removed.

Unfortunately, in providing these advantages a serious series of problems has cropped up, which have been demonstrated to be dangerous and counterproductive, increasing costs and, more importantly, injuring and maiming innocent people.

In my earlier patent, U.S. Pat. NO. 3,473,685, I described a bottle closure of very flexible thermoset synthetic material which has a thin annular insert which fits into the bottle and configurates to its interior surface to affect a tight seal. Thus, the internal gas pressure in the bottle is used to aid in maintaining the seal by pressing the insert against the bottle wall.

The present invention extends and advances the teachings of the prior patent to "screw-on" bottles while incorporating a simple relief valve to cause the bottle closure to balloon out or burst when the pressure within the bottle exceeds a predetermined level.

Both the "crown" and the "screw-on" cap have the detail in common that they are fabricated on the bottle, while the cap of the present invention and as covered by U.S. Pat. No. 3,473,685 is fabricated apart from the bottling process and inserted at the bottling plant.

The "screw-on" cap is applied at the bottler's plant to glass bottles which have been blown by the glass maker. The glass bottle makers have traditionally worked with wide tolerances. Considering the method by which the crown type bottle is capped, the wide tolerances did not present too many difficulties. But with the screw-on system, unforeseen problems were experienced at the bottler's plant which became serious public dangers.

During the capping operation of the screw-on cap, an arm extends from the capping equipment to the top of the bottle, mating the cap with the glass. Then the bottle is rotated while the cap is configurated to the threads on the neck of the bottle.

If the glass is too tall (the tolerance is at the high side), the arm strikes the glass, knocking it off the track, and the machinery is brought to a halt so that the liquid and broken glass can be cleaned up.

If the glass is too short (the tolerance is at the low side), the arm makes a poor contact with the cap and the bottle and a poorly encapped bottle results.

These two limitations further aggravate an already difficult productivity problem, for the capping rate of the screw-on system is a fraction of that of the older method of clamping the cap on the bottle's crown.

The motion of capping the crown bottle likewise assumes importance. The metal blank is placed atop the bottle and a plunger, operating along the axis of the bottle, secures the blank while the edges of the blank are configurated around the annular bead (the crown) of the bottle.

A more serious public issue is that of spontaneous explosions, which cause injury and maiming of innocent people. The National Commission on Product Safety in its report of June, 1970 stated (Page 17), in part, "we find that glass bottles used for carbonated beverages present an unreasonable risk to consumers. When one of these bottles fails, the glass under internal pressure burst into splinters...."

The wide tolerances described above can result in thin and/or weakened glass walls and one of these thinned walls can be the source of a bottle failure.

The obviation of this problem is in providing a relief valve in the cap. When the internal pressure builds up beyond a predetermined value the relief valve will balloon out and/or burst. The pressure point at which the cap balloons out will be well below the burst-pressure of the glass so that no excessive pressure will be applied to the glass and the danger of glass shattering and splintering and injuring innocent bystanders can be substantially reduced, if not eliminated.

It is the purpose of the present invention to provide a bottle closure which overcomes the aforementioned problems. Accordingly, it is an object of the invention to provide a flexible thermoset bottle closure which allows the mating of the bottle closure to the top of a screw-on bottle with a consistently proper seal notwithstanding the wide tolerances encountered in the glass manufacturing industry.

A related object of the invention is to provide a bottle closure of flexible thermoset material to effect a tight seal in a screw-on bottle.

A further object of the invention is to provide a bottle closure which includes a relief valve responsive to the internal pressure within the bottle to balloon or burst at pressures below the burst-pressure of the glass.

A still further object is to provide a bottle cap that can be emplaced on the bottle with a simple, single stroke motion which utilizes the stretchable characteristics of the flexible material to accommodate the wide tolerances experienced in the bottle making industry.

These objects are accomplished in the provision of a bottle closure of thermoset synthetic material having a flexible corrugated annular insert and a flexible annular outer wall which covers the bead on the receptacle. A portion of the geometry in the base of the closure is of a thickness and design adapted to burst at a predetermined pressure within the bottle. An annular shoulder on a severable skirt extends laterally beyond the outer annular wall for fitting against plunger means for urging an internal annular groove over an annular bead on the closure with an internal shoulder on the skirt fitting into an undercut on the bead.

These and other objects and features will be more fully understood in the following detailed description of the invention in which:

FIG. 1 is a perspective view of a bottle closure according to the invention,

FIG. 2 is a perspective view of the top of a bottle having threads to receive a screw-on bottle closure, FIG. 3 is a sectional view of the bottle closure through line 3—3 in FIGS. 1 and 2 shown atop the threaded bottle top of FIG. 2, FIG. 4 is a similar sectional view of a second embodiment of the bottle closure, FIG. 5 is a representation of a portion of the plunger arm of capping equipment suitable for properly encapping the bottle closure of the present invention to a threaded bottle top, and FIG. 6 is an enlarged sectional view of the plunger of FIG. 5 shown in the extreme extension position, applying the bottle closure to the threaded bottle top.

Referring to FIGS. 1 to 3, a flexible bottle closure, shown generally as 10, composed of thermosetting synthetic rubber such as an ethylene-propylene rubber of a controllable durometer in the region of 60, Shore, scale A. The closure 10 consists of a cap having a base 13 from which a flexible outer hollow annular wall 14 depends. The outer annular wall 14 has a deep inward facing threaded groove 15 which surrounds and substantially configurates to a threaded bead 16 near the mouth of the bottle 11. In this way the wall 14 will fit over and grasp about the threaded bead 16.

Also depending from the base 13 is a flexible hollow annular insert 17. The insert 17 extends from the base 13 a distance as great or greater than its inside diameter as measured at the base 13. Advantageously, the insert 17 is designed to configurate to the inner wall 26 of the bottle 11 and has a corrugation or ripple 18 over its entire length, the purpose of each of which will be hereinafter explained. The insert 17 is the thinnest portion of the closure except for the relief portion 28. The insert 17 is substantially right circular on its corrugated outer wall 18 from the base 13 to its end and has a tapered portion 23 which configurates to the inner wall 26. The inward facing groove 15 is deep relative to prior closures, its depth being in the order of one fourth its width or more.

The outer wall 14 has a skirt 19 extending from it which configurates around the bead 21 of the portion of bottle 11. The junction 20 of the skirt 19 and the outer wall 14 is purposely weakened therealong by scoring or perforating.

The skirt 19 has an internal annular beveled groove 24 which fits tightly about the bead 21 with its shoulder 25 fitting into an undercut 27 on the bead 21. The skirt 19 extends laterally beyond the annular wall 14 in a shoulder 33.

The base 13 of the closure has a thinned circular portion 28 comprised of aligned circular indents on its upper and lower sides. The thinned portion will balloon out or burst in response to pressures within the bottle which exceed a predetermined level.

The level is determined on the basis of the composition and minimum thickness of the glass. The predetermined burst level for the thinned portion 28 should be at a margin of safety below the burst level of the bottle and the diameter and thickness of the thinned portion 28 is selected to yield this result. This is a junction of the material of the bottle closure. In the embodiment described, the material is highly flexible, thermosetting, synthetic rubber such as ethylene-propylene.

For ordinary, returnable screw-on bottles common to the soft drink industry, the predetermined burst level for the thinned portions 28 is in the order of 100 PSI. It has been found that thinned membrane 28 or synthetic rubber ½ mm in thickness and 8 mm diameter will burst at this pressure level.

FIG. 4 shows a second embodiment of the relief valve. An inverted *V* ring 35 with a circular apex 36 is molded into base 13. As the pressure builds up base 13 will curve, stretching the material at the apex 36. This taut membrane can be designed to rupture at any desired internal pressure. The rupture pressure will always be below the burst pressure of the glass.

In FIGS. 3 and 4 the bottle closure 10 is shown upon a bottle 11 as it might be affixed by a bottler. In this arrangement, the skirt 19, integral with and extending from the outer wall 14, passes over the bead 21 of the bottle. The skirt 19 will conform to and hug the bottle surface 21 tightly. As a further precaution, the skirt 19 can be glued to the outer surface 21 to permanently secure the skirt thereto. As shown, the bottle closure 10 is tightly secured to the bottle 11.

To release the closure, one need only press a sharp edge such as a knife or even one's finger nail at the perforated junction 20. The material employed will easily separate at the line of weakness. Thereafter, the closure 10 is removed from the bottle by either unscrewing or pulling cap 10. The thin, very flexible inner wall 17 will easily distort so that the closure can be removed from the bottle, leaving the skirt 19 behind as a permanent ring about the bottle surface 21. Thereafter the closure 10 can be repeatedly used on the same bottle or any other bottle of similar opening size.

Referring to FIGS. 5 and 6, the end portion of a plunger arm 30 of suitable capping equipment is shown encapping the bottle closure 10 on a threaded top of a bottle 11. A single downward motion of the plunger arm will mate the closure to the bottle. Suitable capping equipment and mechanisms which feeds the bottle closure to the plunger end, advances the bottles to the encapping station and provides the reciprocating motion to the plunger are known to the bottling and related arts. No complicated cams and combined rotary reciprocated motions are needed. A single downward stroke is all that is required.

The bottle closure 10 is seated in a hollow cylinder 32 at the plunger end 30, formed by the hollow 31.

As the plunger arm 30 approaches the bottom of its downward motion, the skirt 19 of the bottle closure 10 passes about the threaded bead 16 of the bottle 11. As the plunger arm 30 continues its downward motion to its bottom position the skirt 19 is stretched downward bringing its shoulder 25 below the undercut 27 on the annular bead 21 on the bottle.

The weakened junction 20 is stretched to less than its elastic limit and does not separate. As the plunger arm 30 proceeds in its upwards motion, the shoulder 25 moves to seat in the undercut 27 in tending to restore to its normal position and the bottle closure will rotate until the inward facing threaded groove 15 mates with the threads 16 on the bottle 11.

The insert 17 is sufficiently flexible so that its corrugated outer wall 18 can be inserted within the bottle. The corrugations 18 provide sealing positions within the bottle and act as gates to prevent gases within the bottle from passing between the insert 17 and the internal wall 26 of the bottle.

The pressure within the bottle, in the space above the bottle contents, is the same in all directions. This pressure, to whatever degree it may be found, presses the highly flexible insert 17 against the bottle wall 26 and the insert 17 configurates thereto. The greater the pressure within the bottle, such as large pressures which might occur from hot or highly carbonated contents, the more the highly flexible insert 17 is pressed against the bottle wall. Thus, the greater is the force which seals the bottle. The upward pressure against the base 13 is more than offset by the sideways pressure against the insert 17, which is long compared to its diameter.

What is claimed is:

1. A closure for a receptacle having an a first external bead in the vicinity of the mouth thereof and a second external bead lower than the first bead, comprising a one-piece closure construction having:

a hollow flexible annular insert of flexible thermoset material integral with the base and of at least equivalent flexibility depending from the base insertable within the receptacle and adapted to press and increasingly seal against and conform to an internal wall of the receptacle under the influence of increasing pressure within the receptacle, corrugations on said insert for pressing against the internal wall of the receptacle, hollow outer annular wall of flexible thermoset synthetic material, shorter than said insert, integral with the base and surrounding the insert and depending from the base for substantially surrounding and covering the first bead on the receptacle and adapted to press and increasingly seal against the bead under the influence of increasing pressure within the receptacle, means formed integrally with the base for relieving fluid pressures within the receptacle above a predetermined level comprising a thinned portion of the base over the mouth of the receptacle of a geometry and thickness adapted to burst at a level of fluid pressure above a predetermined level of sealing pressure within the receptacle, severable skirt means extending from the hollow outer annular wall and adapted to engage the second external bead tightly, said skirt means having flexibility and stretch characteristics which facilitate advancing the skirt axially over the second external bead without tearing the skirt means, the outer annular wall or the skirt means from the outer annular wall, said skirt means further having annular shoulder means extending laterally beyond the hollow outer annular wall for receiving plunger means for urging the closure over the receptacle and axially over the first external bead and into mating fit on the first external bead and for urging the skirt into engagement with the second external bead, the length of the outer annular wall and the skirt means being such that it is necessary to stretch the skirt means in the axial direction of the receptable to engage the second external bead.

2. A closure according to claim 1 in which the flexible insert is substantially right circular having corrugations substantially over its length.

3. A closure according to claim 2 in which the hollow flexible insert has an inner wall that is tapered at its free end.

4. A closure according to claim 1 in which the lower external bead on the receptacle has an undercut and the skirt has an internal annular groove which fits tightly about the bead and a shoulder which fits into the undercut.

5. A closure according to claim 1 in which the hollow outer annular wall has an internal threaded groove which mates with upper external bead which is threaded in form.

6. A closure according to claim 1 in which the outer annular wall is adapted to fit within a hollow at the end of a plunger with the annular shoulder adapted to fit against the end of the plunger.

7. A closure according to claim 1 in which the thinned portion of the base comprises a ring indented on the lower side of the base.

8. A closure according to claim 7 in which the ring indentation has substantially the cross-section of an inverted V.

* * * * *